US008136575B2

(12) United States Patent
Kagehira et al.

(10) Patent No.: US 8,136,575 B2
(45) Date of Patent: Mar. 20, 2012

(54) TWIN-ROLL CONTINUOUS CASTING MACHINE AND ROLLING EQUIPMENT

(75) Inventors: Kiyoshi Kagehira, Hiroshima (JP); Tatsunori Sugimoto, Hiroshima (JP)

(73) Assignee: Mitsubishi-Hitachi Metals Machinery, Inc., Tokyo (JP)

( * ) Notice: Subject to any disclaimer, the term of this patent is extended or adjusted under 35 U.S.C. 154(b) by 15 days.

(21) Appl. No.: 12/603,923

(22) Filed: Oct. 22, 2009

(65) Prior Publication Data

US 2010/0101751 A1 Apr. 29, 2010

(30) Foreign Application Priority Data

Oct. 23, 2008 (JP) ..... 2008-272772

(51) Int. Cl.
*B22D 11/06* (2006.01)
*B22D 11/12* (2006.01)
*B22D 11/128* (2006.01)

(52) U.S. Cl. ..... 164/428; 164/442; 164/448

(58) Field of Classification Search ..... 164/428, 164/480, 417, 476, 441, 442, 447, 448
See application file for complete search history.

(56) References Cited

U.S. PATENT DOCUMENTS 5,651,411 A * 7/1997 Hirano et al. ..... 164/459

FOREIGN PATENT DOCUMENTS

JP 63-104756 A * 5/1988
JP 5-305399 A * 11/1993
JP 2006-175488 A * 7/2006

* cited by examiner

*Primary Examiner* — Kevin P Kerns
(74) *Attorney, Agent, or Firm* — Birch, Stewart, Kolasch & Birch, LLP

(57) ABSTRACT

A twin-roll continuous casting machine includes: a moving mechanism for moving, relative to one roll, another roll; a plurality of upper side support rolls for supporting the one-roll side of a cast slab separated from the one roll and withdrawn; and a plurality of lower side support rolls for supporting the other-roll side of the cast slab pulled out from the clearance between both rolls. The upper side support rolls are rotatably supported by first bearers, while the lower side support rolls are rotatably supported by second bearers having a force for urging the lower side support rolls toward the cast slab. The cast slab is transported, with an upper surface portion of the cast slab pulled out from the clearance between both rolls serving as a reference surface.

4 Claims, 5 Drawing Sheets

TWIN-ROLL CONTINUOUS CASTING MACHINE AND ROLLING EQUIPMENT

BACKGROUND OF THE INVENTION

1. Field of the Invention

This invention relates to a twin-roll continuous casting machine and rolling equipment.

2. Description of the Related Art

A continuous casting machine is a machine for producing a cast slab by transferring refined molten steel from a ladle, which is a transport container, into a tundish, pouring the molten steel into a pouring basin through a nozzle provided at the bottom of the tundish, and continuously solidifying it.

Among continuous casting machines is a twin-roll continuous casting machine using a synchronous twin-roll mold in which a mold moves together with a cast slab.

For example, Patent Document 1 describes a twin-roll continuous casting machine comprising a pair of rolls which rotate in directions opposite to each other and in which the diameters of both ends in the roll axis direction of one of the rolls are larger than the diameter of a central part in the roll axis direction of the one roll. Molten steel is supplied between the pair of rolls to solidify the molten steel on the circumferential surface of each roll. The resulting solidified shells are brought into pressure contact with each other at a minimum gap portion, where the clearance between both rolls is minimal, to produce a cast slab. The cast slab, which has solidified on the surface, but has an unsolidified molten steel remaining at the center, is then extracted from the clearance between the rolls. In this twin-roll continuous casting machine, the cast slab exiting from the minimum gap portion is wound around the circumferential surface of one of the rolls by a predetermined contact arcuate length, then separated from this roll and withdrawn.

SUMMARY OF INVENTION

Technical Problem

If cast slabs of different thicknesses are to be produced by the twin-roll continuous casting machine described in the above-mentioned Patent Document 1, the two rolls have to be brought close to or away from each other according to the thicknesses. For example, when the roll on which to wind the cast slab (i.e., the winding roll) is to be moved relative to the roll opposing the winding roll (i.e., non-winding roll), a clearance arises between the pass line of the cast slab and the roll, thus resulting in the insufficient cooling of the cast slab, or the failure to prevent the occurrence of bulging. Moreover, the roll wound with the cast slab interferes with rolls for supporting the cast slab on a side downstream in the direction of transport of the cast slab. Furthermore, if the cast slab contacting the non-winding roll is located downward, the position of the lower surface of the cast slab changes vertically according to a change in the thickness of the cast slab. If the lower surface of the cast slab subject to such a positional change is supported by a fixed roll immovable in the vertical direction, a redundant force is exerted on the cast slab. Besides, if the lower surface of the cast slab is taken as a reference surface, the problem is posed that a support structure for supporting the upper surface and the lower surface of the cast slab has to be complicated.

The present invention has been proposed in the light of the above-mentioned problems. It is an object of this invention to provide a twin-roll continuous casting machine and rolling equipment which can effectively prevent bulging of a cast slab containing an unsolidified portion in the center, can perform effective cooling of the cast slab, can produce cast slabs of different thicknesses, and can switch the reference surface of the cast piece by a relatively simple configuration.

Solution to Problem

A first aspect of the present invention for solving the above problems is a twin-roll continuous casting machine, including a pair of rolls which rotate in directions opposite to each other and in which diameters of both ends along a roll axis direction of at least one of the rolls are larger than a diameter of a central part in the roll axis direction of the roll, and being configured such that molten steel is supplied between the pair of rolls to solidify the molten steel on a circumferential surface of each roll, thereby forming solidified shells, opposite end portions of the solidified shells are brought into pressure contact at a minimum gap portion, where a clearance between both rolls is minimal, to form a cast slab which has a solidified surface, but has an unsolidified molten steel remaining in a center, the cast slab is pulled out from the clearance between both rolls, and the cast slab is wound around the circumferential surface of one of the rolls by a predetermined contact arcuate length, and then separated from the one roll and withdrawn, the twin-roll continuous casting machine comprising:

adjusting means for moving other of the rolls relative to the one roll;

a plurality of first support rolls for supporting a one-roll side of the cast slab separated from the one roll and withdrawn; and a plurality of second support rolls for supporting an other-roll side of the cast slab pulled out from the clearance between both rolls, wherein the plurality of first support rolls are rotatably supported by first bearers, while the plurality of second support rolls are rotatably supported by second bearers having a force for urging the second support rolls toward the cast slab, and the cast slab is transported, with an upper surface portion of the cast slab pulled out from the clearance between both rolls serving as a reference surface.

A second aspect of the present invention for solving the above problems is rolling equipment comprising:

the twin-roll continuous casting machine according to the first aspect;

a rolling mill group for rolling the cast slab cast by the twin-roll continuous casting machine; and guide means, provided between the twin-roll continuous casting machine and the rolling mill group, for switching a pass line of the cast slab cast by the twin-roll continuous casting machine to a pass line of the rolling mill group, and guiding the cast slab cast by the twin-roll continuous casting machine to the rolling mill group.

According to a third aspect of the present invention, the guide means may comprise a pair of pinch rollers for pinching therebetween the cast slab cast by the twin-roll continuous casting machine, and support rollers arranged between the pair of pinch rollers and the rolling mill group to support a lower side of the cast slab, and the pair of pinch rollers may be arranged to be offset in a transport direction of the cast slab.

According to a fourth aspect of the present invention, the guide means may further comprise cast slab winding and unwinding means for winding the cast slab cast by the twin-roll continuous casting machine and unwinding the wound cast slab.

Advantageous Effects of Invention

With the twin-roll continuous casting machine according to the present invention, bulging of the cast slab containing an unsolidified portion in the center can be effectively prevented, effective cooling of the cast slab can be performed, and the cast slabs of different thicknesses can be prepared. Furthermore, the cast slab can be transported, with the upper surface portion of the cast slab serving as a reference surface, by using a relatively simple configuration.

The rolling equipment according to the present invention has the guide means between the twin-roll continuous casting machine and the rolling mill group for rolling the cast slab cast by the twin-roll continuous casting machine. The guide means switches the pass line of the cast slab cast by the twin-roll continuous casting machine to the pass line of the rolling mill group, and guides the cast slab cast by the twin-roll continuous casting machine to the rolling mill group. Since the cast slab cast by the twin-roll continuous casting machine can be switched to the pass line of the cast slab in the rolling mill group by the guide means, it is not necessary to change the rolling conditions in the rolling mill group according to a change in the pass line, so that a working load can be lessened.

With the rolling equipment according to the present invention, the guide means comprises the pair of pinch rollers for pinching therebetween the cast slab cast by the twin-roll continuous casting machine, and the support rollers arranged between the pair of pinch rollers and the rolling mill group to support the lower side of the cast slab, and the pair of pinch rollers are arranged to be offset in the transport direction of the cast slab. Thus, the cast slab cast by the twin-roll continuous casting machine can be switched to the pass line of the cast slab in the rolling mill group by the guide means.

With the rolling equipment according to the present invention, the guide means comprises the cast slab winding and unwinding means for winding the cast slab cast by the twin-roll continuous casting machine and unwinding the wound cast slab. Thus, the cast slab cast by the twin-roll continuous casting machine can be switched to the pass line of the cast slab in the rolling mill group by the guide means.

DETAILED DESCRIPTION OF THE INVENTION

The best mode for putting into practice the twin-roll continuous casting machine and rolling equipment according to the present invention will now be described concretely based on embodiments of the invention.

First Embodiment

A twin-roll continuous casting machine according to a first embodiment of the present invention will be described with reference to FIG. 1.

Figure 1:
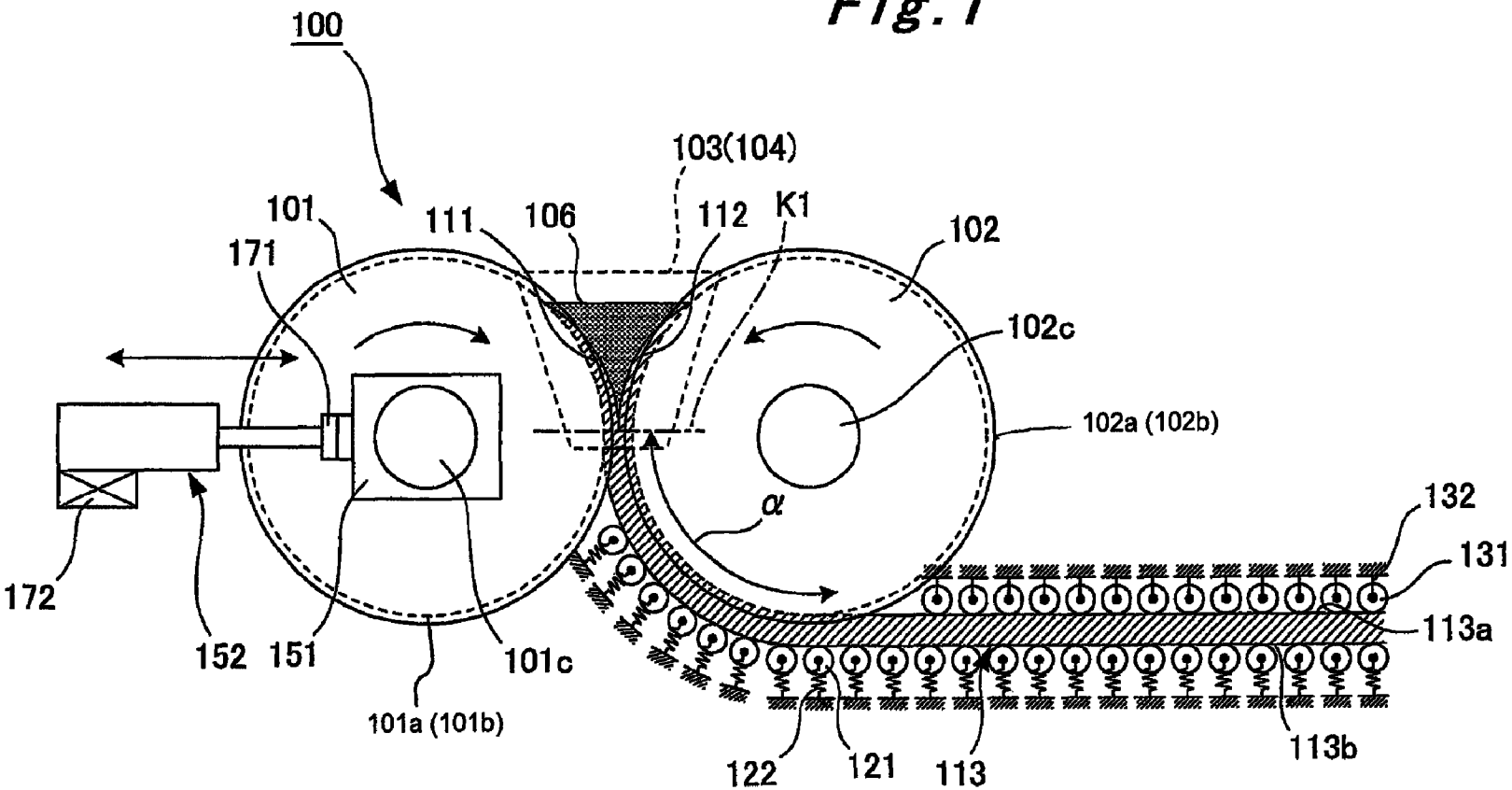
FIG. 1 is a schematic view of a twin-roll continuous casting machine according to a first embodiment of the present invention.

FIG. 1 is a schematic view of the twin-roll continuous casting machine according to the first embodiment of the present invention.

A twin-roll continuous casting machine 100 according to the first embodiment of the present invention comprises a concave roll 101 and a concave roll 102 rotating in directions opposite to each other, as shown in FIG. 1. These rolls are arranged parallel in proximity to each other at the same height position. Both ends in the axial direction of the rolls are provided with side dams 103 and 104 press-bonded to end surfaces of the rolls. An internal space of a movable mold composed of the rolls 101, 102 and the side dams 103, 104, namely, a pouring basin, is supplied with molten steel 106 via a nozzle (not shown).

The concave roll 101 (the other of the rolls) is a roll having stepped portions 101*a* and 101*b* on both ends thereof, and the concave roll 102 (one of the rolls) is also a roll having stepped portions 102*a* and 102*b* on both ends thereof.

When the pair of rolls 101 and 102 rotate about shaft centers 101*c* and 102*c* in the directions opposite to each other, the molten steel 106 is cooled upon making contact with the surfaces of the rolls (each of the surfaces includes the surfaces of the stepped portions) to form solidified shells 111 and 112. The solidified shells 111, 112 grow as the rolls rotate. At a minimum gap portion K1 where the gap or clearance between the rolls is the smallest, end parts of the solidified shell 111 and end parts of the solidified shell 112 are pressure-contacted and integrated. On this occasion, both end parts of the solidified shell 111 and the solidified shell 112 are pressure-contacted and integrated, whereby both solidified shells 111 and 112 are joined together like a sack sewn at the edge, with the molten steel 106 remaining in the center, to form a cast slab 113.

The cast slab 113, which has exited from the minimum gap portion K1, continues to be wound round the circumferential surface of the concave roll 102 by a predetermined contact arcuate length a, is passed through a region defined by the concave roll 102 and a plurality of lower side support rolls 121 (second support rolls) located below the concave roll 102, and then withdrawn away from the concave roll 102.

The lower side support roll 121 is a roll having an axial length nearly equal to the axial length of the roll 102. The lower side support roll 121 may be a roll which does not allow a rotational driving force to spontaneously occur, or a roll which allows a rotational driving force to spontaneously occur. The plurality of lower side support rolls 121 are supported by second bearers 122, such as springs, which have a force for urging the lower side support rolls 121 toward the cast slab 113. Thus, the plurality of lower side support rolls 121 are movable in a following manner responsive to the thickness of the cast slab 113. The second bearers 122 are fixed to a counter or the like.

Since the cast slab 113 is sandwiched between the lower side support rolls 121 and the concave roll 102, contact resistance increases. When the concave roll 102 rotates, therefore, the rotating force of the concave roll 102 is reliably transmitted to the cast slab 113, and a force for delivering the cast slab 113 is reliably generated, so that the withdrawal of the cast slab 113 is carried out.

The cast slab 113 withdrawn from the concave roll 102 is supported by the plurality of lower side support rolls 121 arranged along the transport direction of the cast slab 113, and a plurality of upper side support rolls 131 (first support rolls) arranged along the transport direction of the cast slab 113. Sprays (not shown) are arranged in the vicinity of the lower side support rolls 121 and in the vicinity of the upper side support rolls 131, and water is sprayed from these sprays toward the cast slab 113 to cool the cast slab 113.

The upper side support roll 131 is a roll having an axial length nearly equal to the widthwise length of the cast slab 113. The upper side support roll 131 may be a roll which does not allow a rotational driving force to spontaneously occur, or a roll which allows a rotational driving force to spontaneously occur. The plurality of upper side support rolls 131 are supported by first bearers 132 fixed to a counter or the like. Thus, an upper surface portion 113*a* of the cast slab 113 withdrawn from the concave roll 102 is always maintained in a constant state by the upper side support rolls 131. Downstream, in the transport direction of the cast slab 113, of the concave roll 102, the upper surface portion 113*a* of the cast slab 113 serves as a reference.

The aforementioned minimum gap portion K1 between the rolls is adjusted by a moving mechanism (adjusting means) for moving the other roll 101 toward and away from the one roll 102. This moving mechanism comprises a bearing 151 for rotatably supporting the shaft center 101*c* of the other roll 101, and a cylinder 152 connected to the bearing 151. The cylinder 152 is fixed to a casing or the like (not shown). Thus, a fluid such as an oil is supplied to or discharged from the cylinder 152 by a fluid supply/discharge mechanism (not shown), whereby a cylinder rod extends or contracts, moving the other roll 101 close to or away from the one roll 102 via the bearing. That is, the fluid supply/discharge mechanism constitutes a drive means. The bearing 151 is supported by the counter (not shown).

A pushing force detector 171 (pushing force detecting means) is provided in a leading end portion of the cylinder rod. This pushing force detector 171 detects a pushing force which the extending or contracting motion of the cylinder rod exerts on the bearing. The cylinder 152 is provided with a position detector 172 (position detecting means) for detecting the position of the cylinder rod.

The moving mechanism includes a control device (control means; not shown) for controlling the fluid supply/discharge mechanism. This control device controls the fluid supply/discharge mechanism based on at least one of the position of the other roll 101 detected by the position detector 172, and the pushing force exerted on the bearing 151 connected to the other roll 101, the pushing force detected by the pushing force detector 171, thereby adjusting the position of the other roll 101.

With the twin-roll continuous casting machine 100 according to the present embodiment, therefore, the other roll 101 is moved relative to the one roll 102 by the moving mechanism to adjust the size of the minimum gap portion K1 between the two rolls 101 and 102, whereby the thickness of the cast slab 113 can be changed. Moreover, after the cast slab 113 has been withdrawn from between the rolls 101 and 102, the side of the cast slab 113 facing the one roll 102 is supported by the plurality of upper side support rolls 131, while the side of the cast slab 113 facing the other roll 101 is supported by the plurality of lower side support rolls 121 via the second bearers 122 having the force to urge the lower side support rolls 121 toward the cast slab 113. As a result, the position of the lower side support rolls 121 is adjusted in accordance with the thickness of the cast slab 113 withdrawn from between the rolls 101 and 102. Thus, bulging of the cast slab 113 containing an unsolidified portion in the center can be effectively prevented, effective cooling of the cast slab 113 can be performed, and the cast slabs 113 of different thicknesses can be prepared. Furthermore, the cast slab 113 can be transported, with the upper surface portion 113*a* of the cast slab 113 as a reference surface, to fix the pass line of the cast slab 113, by using a relatively simple configuration.

The present invention has been described using the twin-roll continuous casting machine 100 equipped with the concave rolls 101, 102 each having the stepped portions in the opposite ends thereof. However, the twin-roll continuous casting machine may be one equipped with concave rolls each having an outwardly widening taper form followed by stepped portions in the opposite ends thereof, instead of the concave rolls 101 and 102. Alternatively, the twin-roll continuous casting machine may be one equipped with a pair of rolls, at least one of which is a concave roll, and which together can subject solidified shells to pressure contact to form a cast slab like a sack sewn at the edge. An example of such a twin-roll continuous casting machine comprises rolls each having stepped portions at both ends and each being in the form of an hourglass having a diameter gradually decreasing toward the center in the axial direction. Any of these twin-roll continuous casting machines shows the same actions and effects as those of the above-mentioned twin-roll continuous casting machine 100.

In the foregoing descriptions, the twin-roll continuous casting machine 100 is used which includes the two concave rolls 101 and 102 arranged to oppose each other, the rolls 101 and 102 having the same diameter. However, the twin-roll continuous casting machine may be one having two concave rolls arranged to oppose each other, one of the concave rolls being wound with a predetermined contact arcuate length of a cast slab, and the other concave roll having a smaller diameter than the diameter of the one concave roll. Even a twin-roll continuous casting machine of such a configuration exhibits the same actions and effects as those of the twin-roll continuous casting machine according to the above-described first embodiment, can ensure a space below the other roll, and enables this space to easily accommodate a spray or the like for ejecting water toward the cast slab.

Second Embodiment

A twin-roll continuous casting machine according to a second embodiment of the present invention will be described with reference to FIG. 2.

Figure 2:
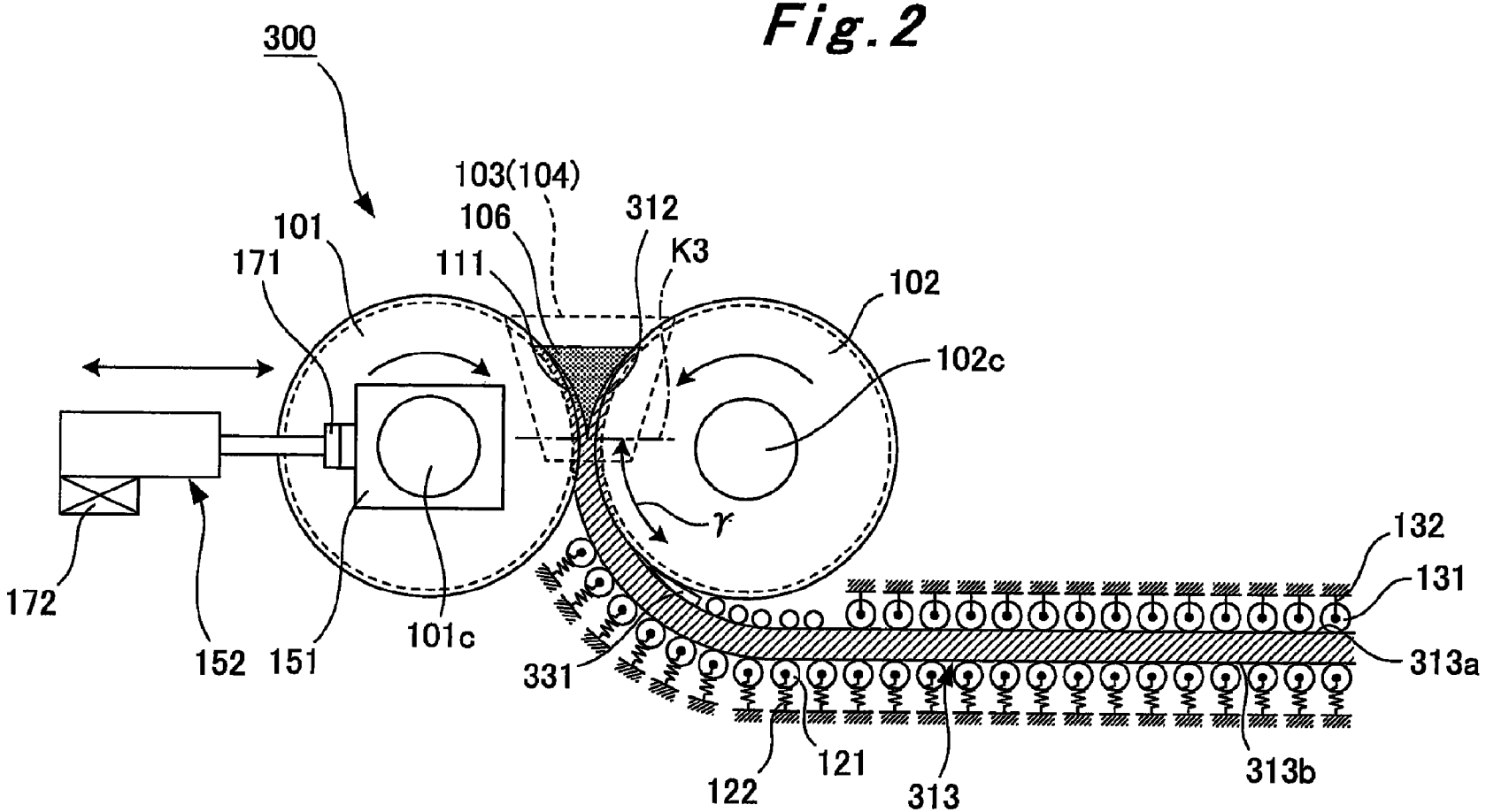
FIG. 2 is a schematic view of a twin-roll continuous casting machine according to a second embodiment of the present invention.

FIG. 2 is a schematic view of the twin-roll continuous casting machine according to the second embodiment of the present invention.

The twin-roll continuous casting machine according to the present embodiment is the twin-roll continuous casting machine according to the aforementioned first embodiment, however, in which the contact arcuate length of the cast slab wound round the one roll is shortened.

In the present embodiment, the same instruments as those of the twin-roll continuous casting machine according to the aforementioned first embodiment will be assigned the same numerals as in the first embodiment, and explanations for them will be omitted.

A twin-roll continuous casting machine 300 according to the present embodiment comprises a concave roll 101 and a concave roll 102 rotating in directions opposite to each other, as shown in FIG. 2. These rolls are arranged parallel in proximity to each other at the same height position. Both ends in the axial direction of the rolls are provided with side dams 103 and 104 press-bonded to end surfaces of the rolls. An internal space of a movable mold composed of the rolls 101, 102 and the side dams 103, 104, namely, a pouring basin, is supplied with molten steel 106 via a nozzle (not shown).

When the pair of rolls 101 and 102 rotate in the directions opposite to each other, the molten steel 106 is cooled upon contact with the surfaces of the rolls (each of the surfaces includes the surfaces of the stepped portions) to form solidified shells 111 and 312. The solidified shells 111, 312 grow as the rolls rotate. At a minimum gap portion K3 where the clearance between the rolls is the smallest, end parts of the solidified shell 111 and end parts of the solidified shell 312 are pressure-contacted and integrated. On this occasion, both end parts of the solidified shell 111 and the solidified shell 312 are pressure-contacted and integrated, whereby both solidified shells 111 and 312 are joined together like a sack sewn at the edge, with the molten steel 106 remaining in the center, to form a cast slab 313.

The cast slab 313, which has exited from the minimum gap portion K3, continues to be wound round the circumferential surface of the concave roll 102 by a predetermined contact arcuate length y, and is passed through a region defined by the concave roll 102 and a plurality of lower side support rolls 121 (second support rolls) located below the concave roll 102. Then, the cast slab 313 is stripped from the other roll 102 by a scraper 331 (stripping means) located below the other roll 102.

The lower side support roll 121 is a free roll (a roll without spontaneous generation of a rotational driving force) having an axial length nearly equal to the axial length of the roll 102. The lower side support rolls 121 are supported by second bearers 122, such as springs, which have a force for urging the lower side support rolls 121 toward the cast slab 313. Thus, the lower side support rolls 121 are movable in a following manner responsive to the thickness of the cast slab 313.

Since the cast slab 313 is sandwiched between the concave roll 102 and the lower side support rolls 121, its contact resistance increases. When the concave roll 102 rotates, therefore, the rotating force of the concave roll 102 is reliably transmitted to the cast slab 313, and a force for delivering the cast slab 313 is reliably generated, so that the withdrawal of the cast slab 313 is carried out.

The cast slab 313 stripped from the concave roll 102 by the scraper 331 is withdrawn while being supported by the lower side support rolls 121 and upper side support rolls 131 (first support rolls). Sprays (not shown) are arranged in the vicinity of the lower side support rolls 121 and in the vicinity of the upper side support rolls 131, and water is sprayed from these sprays toward the cast slab 313 to cool the cast slab 313.

Thus, an upper surface portion 313*a* of the cast slab 313 withdrawn from the concave roll 102 is always maintained at a constant level by the upper side support rolls 131. Downstream, in the transport direction of the cast slab 313, of the concave roll 102, the upper surface portion 313*a* of the cast slab 313 serves as a reference.

The twin-roll continuous casting machine 300 according to the present embodiment, therefore, exhibits the same actions and effects as those of the twin-roll continuous casting machine 100 according to the aforementioned first embodiment. By adjusting the position of the scraper 331, moreover, the twin-roll continuous casting machine 300 can easily control the position where the cast slab 313 is separated from the one roll 102, and can suppress a change in the quality of the cast slab 313.

Third Embodiment

Rolling equipment according to a third embodiment of the present invention will be described with reference to FIG. 3.

Figure 3:
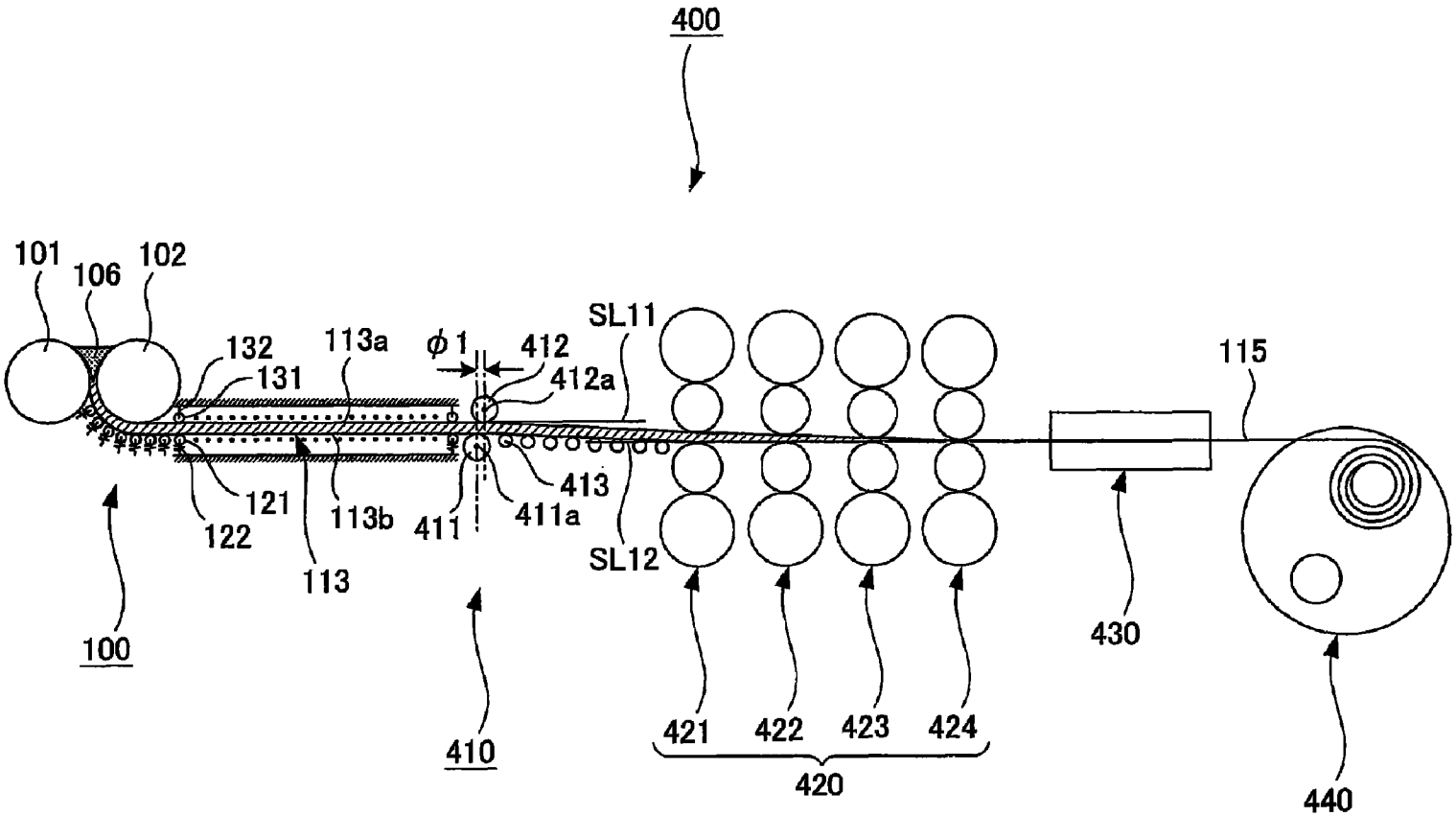
FIG. 3 is a schematic view of rolling equipment according to a third embodiment of the present invention.

FIG. 3 is a schematic view of the rolling equipment according to the third embodiment of the present invention.

The rolling equipment according to the present embodiment is equipment equipped with the twin-roll continuous casting machine according to the aforementioned first embodiment.

In the present embodiment, the same instruments as those of the twin-roll continuous casting machine according to the aforementioned first embodiment will be assigned the same numerals as in the first embodiment, and explanations for them will be omitted.

Rolling equipment 400 according to the present embodiment, as shown in FIG. 3, comprises the twin-roll continuous casting machine 100, a rolling mill group (a group of rolling mills) 420 for rolling the cast slab cast by the twin-roll continuous casting machine 100, cooling equipment 430 for cooling a steel plate 115 formed upon rolling of the cast slab 113 by the rolling mill group 420, and a take-up device 440 for taking up the steel plate 115 cooled by the cooling equipment 430.

The rolling mill group 420 is composed of four rolling mills, i.e., four-high mills 421, 422, 423 and 424.

A guide device 410 (guide means) is disposed between the twin-roll continuous casting machine 100 and the rolling mill group 420. This guide device 410 pinches the cast slab 113, which has been cast by the twin-roll continuous casting machine 100, between an upper pinch roller 412 and a lower pinch roller 411, and transports it to the rolling mill group 420 by transport rollers 413 (support rollers). The lower pinch roller 411 and the upper pinch roller 412 are arranged in an offset relation. Concretely, the shaft center 412*a* of the upper pinch roller 412 is positioned to be offset with respect to the shaft center 411*a* of the lower pinch roller 411 by $\phi$1 toward the inlet side of the rolling mill group 420.

The lower pinch roller 411 and the upper pinch roller 412 are arranged in offset relation, as described above. Although the upper surface portion 113*a* of the cast slab 113 cast by the twin-roll continuous casting machine 100 has served as a reference surface designated as a pass line SL11, therefore, the cast slab 113 can be transported, with the lower surface portion 113*b* of the cast slab 113 being used as a reference surface designated as a pass line SL12 on the inlet side of the rolling mill group 420. That is, the guide device 410 can switch the pass line SL11 of the cast slab 113 cast by the twin-roll continuous casting machine 100 to the pass line SL12 of the rolling mill group 420, and enables the cast slab 113 cast by the twin-roll continuous casting machine 100 to be guided to the rolling mill group 420. Thus, the slackness of the cast slab 113 on the side downstream of the rolls 101 and 102 can be prevented, and in this condition, the cast slab 113 can be transported to the rolling mill group 420.

With the rolling equipment 400 according to the present embodiment, therefore, the cast slab 113 cast by the twin-roll continuous casting machine 100 can be switched to the pass line SL12 of the cast slab 113 in the rolling mill group 420 by the guide device 410. As a result, it is not necessary to change the rolling conditions in the rolling mill group 420 according to a change in the pass line, so that a working load can be lessened.

Fourth Embodiment

Rolling equipment according to a fourth embodiment of the present invention will be described with reference to FIG. 4.

Figure 4:
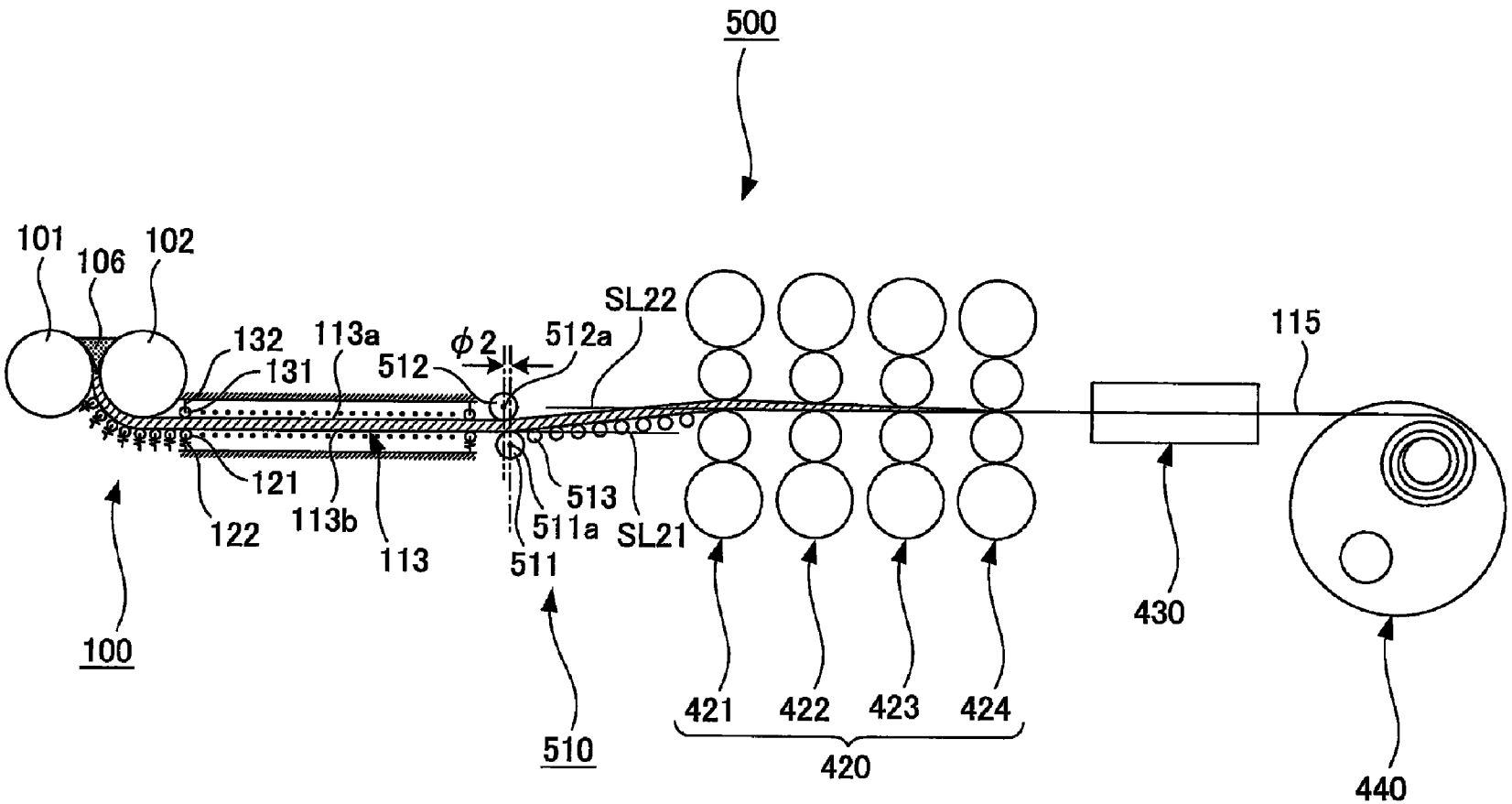
FIG. 4 is a schematic view of rolling equipment according to a fourth embodiment of the present invention.

FIG. 4 is a schematic view of the rolling equipment according to the fourth embodiment of the present invention.

The rolling equipment of the present embodiment is the rolling equipment according to the above-mentioned third embodiment, however, in which the positional relationship between the pass line of the twin-roll continuous casting machine and the pass line of the rolling mill group is changed.

In the present embodiment, the same instruments as those of the rolling equipment according to the aforementioned third embodiment will be assigned the same numerals as in the third embodiment, and explanations for them will be omitted.

Rolling equipment 500 according to the present embodiment, as shown in FIG. 4, has a guide device 510 (guide means) disposed between the twin-roll continuous casting machine 100 and the rolling mill group 420. This guide device 510 pinches the cast slab 113, which has been cast by the twin-roll continuous casting machine 100, between an upper pinch roller 512 and a lower pinch roller 511, and transports it to the rolling mill group 420 by transport rollers 513 (support rollers). The lower pinch roller 511 and the upper pinch roller 512 are arranged in an offset relation. Concretely, the shaft center 512*a* of the upper pinch roller 512 is positioned to be offset with respect to the shaft center 511*a* of the lower pinch roller 511 by $\phi 2$ toward the outlet side of the twin-roll continuous casting machine 100.

The lower pinch roller 511 and the upper pinch roller 512 are arranged in offset relation, as described above. Although the upper surface portion 113*a* of the cast slab 113 cast by the twin-roll continuous casting machine 100 has served as a reference surface designated as a pass line SL21, therefore, the cast slab 113 can be transported, with the lower surface portion 113*b* of the cast slab 113 being used as a reference surface designated as a pass line SL22 on the inlet side of the rolling mill group 420. That is, the guide device 510 can switch the pass line SL21 of the cast slab 113 cast by the twin-roll continuous casting machine 100 to the pass line SL22 of the rolling mill group 420, and enables the cast slab 113 cast by the twin-roll continuous casting machine 100 to be guided to the rolling mill group 420. Thus, the slackness of the cast slab 113 on the side downstream of the rolls 101 and 102 can be prevented, and in this condition, the cast slab 113 can be transported to the rolling mill group 420.

With the rolling equipment 500 according to the present embodiment, therefore, the cast slab 113 cast by the twin-roll continuous casting machine 100 can be switched to the pass line SL22 of the cast slab 113 in the rolling mill group 420 by the guide device 510. As a result, it is not necessary to change the rolling conditions in the rolling mill group 420 according to a change in the pass line, so that a working load can be lessened.

Fifth Embodiment

Rolling equipment according to a fifth embodiment of the present invention will be described with reference to FIG. 5.

Figure 5:
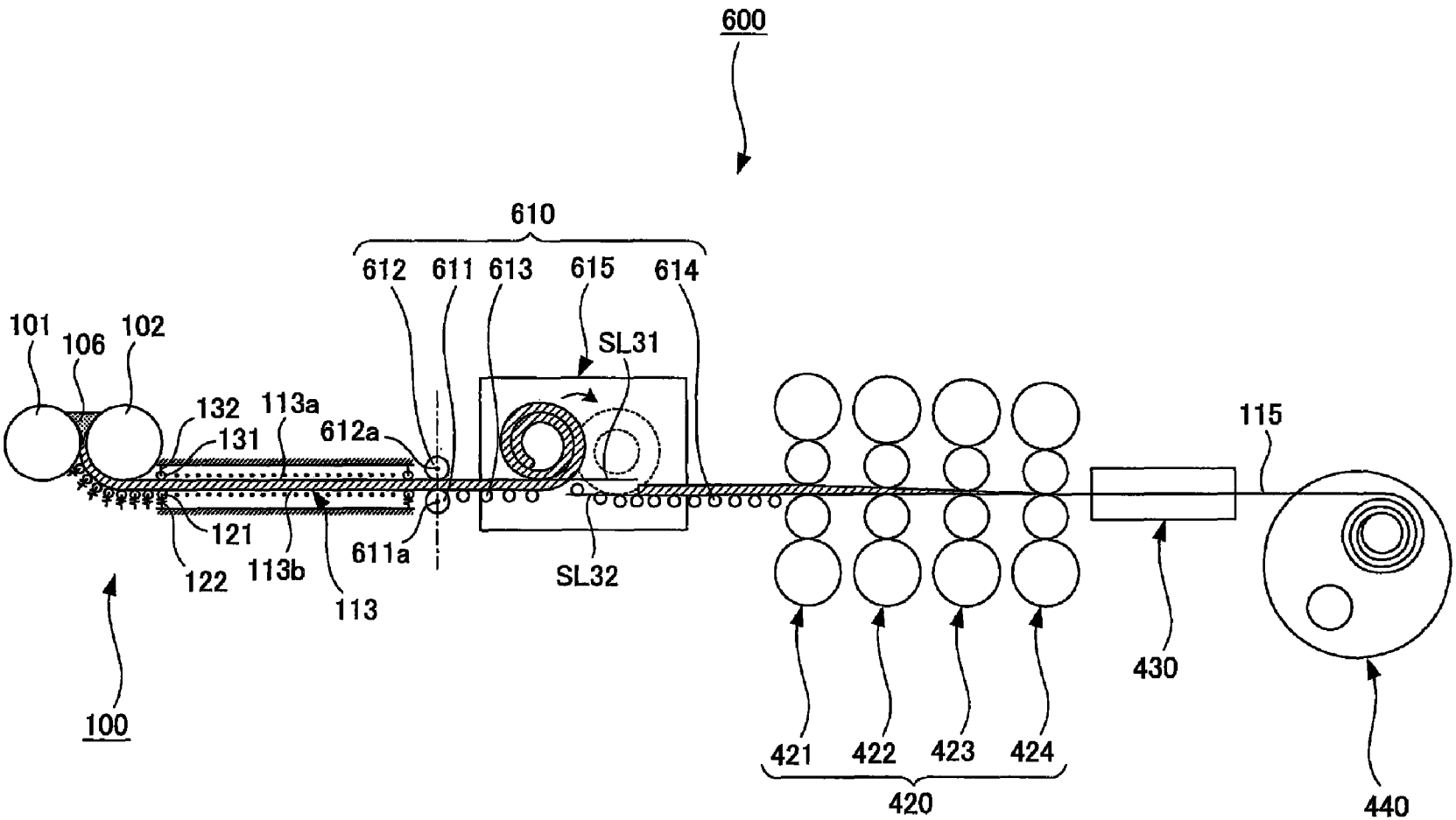
FIG. 5 is a schematic view of rolling equipment according to a fifth embodiment of the present invention.

FIG. 5 is a schematic view of the rolling equipment according to the fifth embodiment of the present invention.

The rolling equipment of the present embodiment is the rolling equipment according to the above-mentioned third embodiment, however, in which the guide device is changed.

In the present embodiment, the same instruments as those of the rolling equipment according to the aforementioned third embodiment will be assigned the same numerals as in the third embodiment, and explanations for them will be omitted.

Rolling equipment 600 according to the present embodiment, as shown in FIG. 5, has a guide device 610 (guide means) disposed between the twin-roll continuous casting machine 100 and the rolling mill group 420. This guide device 610 pinches the cast slab 113, which has been cast by the twin-roll continuous casting machine 100, between an upper pinch roller 612 and a lower pinch roller 611, and allows the cast slab 113 to be once wound in a coil box 615 by transport rollers 613 (inlet-side support rollers). The cast piece 113 wound in the coil box 615 is paid out, and transported to the rolling mill group 420 by transport rollers 614 (outlet-side support rollers). The shaft center 612*a* of the upper pinch roller 612 is positioned to be consistent with the shaft center 611*a* of the lower pinch roller 611 on a vertical cross section.

As described above, the cast slab 113 is once wound in the coil box 615, then paid out and transported to the rolling mill group 420. Although the upper surface portion 113*a* of the cast slab 113 cast by the twin-roll continuous casting machine 100 has served as a reference surface designated as a pass line SL31, therefore, the cast slab 113 can be transported, with the lower surface portion 113*b* of the cast slab 113 being used as a reference surface designated as a pass line SL32 on the inlet side of the rolling mill group 420. That is, the guide device 610 can switch the pass line SL31 of the cast slab 113 cast by the twin-roll continuous casting machine 100 to the pass line SL32 of the rolling mill group 420, and enables the cast slab 113 cast by the twin-roll continuous casting machine 100 to be guided to the rolling mill group 420. Thus, the slackness of the cast slab 113 on the side downstream of the rolls 101 and 102 can be prevented, and in this condition, the cast slab 113 can be transported to the rolling mill group 420.

With the rolling equipment 600 according to the present embodiment, therefore, the cast slab 113 cast by the twin-roll continuous casting machine 100 can be switched to the pass line SL32 of the cast slab 113 in the rolling mill group 420 by the guide device 610. As a result, it is not necessary to change the rolling conditions in the rolling mill group 420 according to a change in the pass line, so that a working load can be lessened.

Other Embodiments

The rolling equipments 400, 500 and 600 in the above-mentioned third, fourth and fifth embodiments may have the twin-roll continuous casting machine 300 according to the second embodiment instead of the twin-roll continuous casting machine 100 according to the first embodiment. It is also permissible to change the number of the rolling mills included in the rolling mill group 420, or to use rolling equipment in which the four-high mills 421, 422, 423 and 424 of the rolling mill group 420 have been replaced by six-high mills, pair cross mills, Z-high mills of the 18-high type, 20-high Sendzimir mills, cluster mills, or 12-high Rohn mills. Even such rolling equipment exhibits the same actions and effects as those of the above rolling equipments 400, 500 and 600.

INDUSTRIAL APPLICABILITY

The twin-roll continuous casting machine and rolling equipment according to the present invention can effectively prevent bulging of a cast slab containing an unsolidified portion in the center, can perform effective cooling, can produce cast slabs of different thicknesses, and can transport the cast slab, with the upper side of the cast slab serving as a reference surface. Thus, the casting machine and rolling equipment can be advantageously utilized in the steel industry.

REFERENCE SIGNS LIST

100, 300 Twin-roll continuous casting machine
101, 102 Concave roll

103, 104 Dam
106 Molten steel
111, 112, 312 Solidified shell
113, 313 Cast slab
121 Lower side support roll (second support roll)
122 Second bearer
131 Upper side support roll (first support roll)
132 First bearer
151 Bearing
152 Cylinder
171 Pushing force detector
172 Position detector
331 Scraper
400, 500, 600 Rolling equipment
410, 510, 610 Guide device
SL11, SL21, SL31 Reference surface in twin-roll continuous casting machine
SL12, SL22, SL32 Reference surface in rolling equipment

CITATION LIST

Patent Literature

Patent Document 1: JP-A-2006-175488 (see, for example, FIG. 2)

The invention claimed is:

1. A twin-roll continuous casting machine, including a pair of rolls which rotate in directions opposite to each other and in which diameters of both ends along a roll axis direction of at least one of the rolls are larger than a diameter of a central part in the roll axis direction of the roll, and being configured such that molten steel is supplied between the pair of rolls to solidify the molten steel on a circumferential surface of each roll, thereby forming solidified shells, opposite end portions of the solidified shells are brought into pressure contact at a minimum gap portion, where a clearance between both rolls is minimal, to form a cast slab which has a solidified surface, but has an unsolidified molten steel remaining in a center, the cast slab is pulled out from the clearance between both rolls, and the cast slab is wound around the circumferential surface of one of the rolls by a predetermined contact arcuate length, then separated from the one roll, and withdrawn substantially in a horizontal direction in which a side of the cast slab wound around the one roll becomes an upper surface portion of the cast slab, the twin-roll continuous casting machine comprising:

adjusting means for moving other of the rolls relative to the one roll to adjust a thickness of the cast slab;

a plurality of first support rolls for supporting an upper surface portion side of the cast slab at portions extending substantially in the horizontal direction;

a plurality of second support rolls for supporting a lower surface portion side of the cast slab at portions extending substantially in the horizontal direction;

first bearers that rotatably support the plurality of first support rolls; and second bearers that rotatably support the plurality of second support rolls, the second bearers having a force for urging the plurality of second support rolls toward the cast slab to support the plurality of second support rolls in such a manner as to be movable in upward and downward directions in accordance with a change in the thickness of the cast slab, wherein when the other roll is moved relative to the one roll by the adjusting means to adjust the thickness of the cast slab pulled out from the pair of rolls, the plurality of first support rolls are maintained at a constant height by the first bearers, while the plurality of second support rolls are moved in the upward and downward directions by the second bearers in accordance with the change in the thickness of the cast slab, and the cast slab is transported, with the upper surface portion of the cast slab pulled out from the clearance between both rolls serving as a reference surface.

2. A rolling equipment comprising:

the twin-roll continuous casting machine according to claim 1;

a rolling mill group for rolling the cast slab cast by the twin-roll continuous casting machine; and guide means, provided between the twin-roll continuous casting machine and the rolling mill group, for switching a pass line of the cast slab cast by the twin-roll continuous casting machine to a pass line of the rolling mill group, and guiding the cast slab cast by the twin-roll continuous casting machine to the rolling mill group.

3. The rolling equipment according to claim 2, wherein the guide means comprises a pair of pinch rollers for pinching the cast slab cast by the twin-roll continuous casting machine from an upper surface side and a lower surface side thereof, and support rollers arranged between the pair of pinch rollers and the rolling mill group to support the lower surface side of the cast slab, and the pair of pinch rollers are arranged to be offset in a transport direction of the cast slab.

4. The rolling equipment according to claim 2, wherein the guide means further comprises cast slab winding and unwinding means for winding the cast slab cast by the twin-roll continuous casting machine and unwinding the wound cast slab.

* * * * *